United States Patent [19]

McGovern et al.

[11] Patent Number: 5,058,464

[45] Date of Patent: Oct. 22, 1991

[54] ROOF FASTENER INSTALLATION MACHINE

[76] Inventors: Hubert T. McGovern, 98 Christopher Dr., Westfield Mass. 01085; Stanley W. Choiniere, 13 Partridge La., Southwick, Mass. 01077; Joseph F. McGovern, Jr., 54 Briarcliff Dr., Westfield, Mass. 01085

[21] Appl. No.: 414,100

[22] Filed: Sep. 28, 1989

[51] Int. Cl.[5] ..... B25B 23/06

[52] U.S. Cl. ..... 81/57.41; 81/433; 81/435

[58] Field of Search ..... 81/430, 433, 435, 57.4, 81/57.41, 57.22–57.25, 57.32, 57.37; 227/111, 120

[56] References Cited

U.S. PATENT DOCUMENTS

| | | | |
|---|---|---|---|
| 480,530 | 8/1892 | Tobey | 81/433 X |
| 2,886,815 | 5/1959 | Young | 81/57.37 UX |
| 3,173,593 | 3/1965 | Elliott | 227/111 X |

*Primary Examiner*—D. S. Meislin

*Attorney, Agent, or Firm*—Chilton, Alix & Van Kirk

[57] ABSTRACT

An installation machine for sequentially driving fasteners through automatically fed plates for securing insulation to a roof deck employs a pneumatically actuated feed mechanism. The plates are loaded in a chute. A shuttle at the underside of the frame reciprocates to feed a plate in position below a power driver for driving the fastener through the fastener plate. The frame includes a pair of wheels for facilitating the movement of the machine across the roof surface. A pneumatic regulator responsive to release of the power driver regulates the timing of the feed mechanism.

17 Claims, 4 Drawing Sheets

ROOF FASTENER INSTALLATION MACHINE

BACKGROUND OF THE INVENTION

This invention relates generally to devices for installing fasteners for securing roofing material to a roof deck. More particularly, the present invention relates to devices for automatically driving fasteners through plates employed to secure roofing membranes or roofing insulation materials.

There are a number of devices which are employed to facilitate the driving of roofing fasteners into the plates for securing insulation or roofing material to a roof deck. For example, an Olympic standup screw shooter employs a screw gun mounted on a driver shaft enclosed in a cylindrical body. The shaft mounts a screw driver. A loading tube intersects the body for loading a fastener into the shaft. A guide assembly at the lower portion of the body guides the fastener which is held in the guide assembly by spring loaded jaws. The standup tool fastener is placed over the washer or plate and the fastener is driven through the plate into the deck by the screw gun. SFS Stadler fastener insulation equipment for securement of single ply membranes or insulation boards employs a belt of fasteners which are fed to a driving wheel for driving through the retainer disk or plate. A number of conventional roof fastener insulation machines employ wheels for efficiently moving the machines across the roof.

SUMMARY OF THE INVENTION

Briefly stated, the invention in a preferred form is a machine adapted for installing roofing plates/fasteners on a roof comprising a carrier having a frame and front and rear wheels for moving the frame across a roof. A power driver is mounted to the frame and projects generally from the top of the frame. The power driver receives a fastener and torqueably drives the fastener downwardly into the roof. A plate feeder feeds plates for alignment with the fastener received by the driver. The plate feeder comprises a chute spaced from the driver and mounted to the frame for receiving a stack of plates. A shuttle is disposed generally below the frame for releasably receiving the bottom plate from the chute stack and transferring the plate to a position below the power driver. A pneumatic controller is responsive to the operation of the driver for reciprocating the shuttle in coordinated relationship with the driver. The machine functions to automatically position a plate below the driver, and the driver is activatable to drive a fastener through the positioned plate wherein the plate releases from the shuttle and is driven into the roof at a pre-established penetration depth.

A compressor provides a source of compressed air which is supplied to a pneumatic driver for reciprocating the shuttle. The power driver has a casing which is releasably upwardly displaceable after driving a fastener. The controller includes a pivotal member which is positionable in response to the upward displacement of the casing and a pneumatic spool valve which is responsive to a selected position of the pivotal member. The pneumatic valve is displaceable to drive the shuttle toward the chute. A pneumatic regulator implements a pre-established time delay to the pneumatic valve to regulate the timing of the plate feeding unit.

The shuttle defines an opening having a diameter which is approximately equal to the diameter of the plate received in the chute. A plurality of angularly spaced spring loaded fingers are projectable into the opening for releasably supporting a plate in the shuttle. The shuttle is disposed at the underside of the frame. An upright support projects from the frame and mounts a handlebar for facilitating movement of the machine.

An object of the invention is to provide a new and improved installation machine for installing roofing fasteners and plates for securement of membrane or roofing insulation to a roof deck.

Another object of the invention is to provide a new and improved roof fastener installation machine for automatically feeding plates and driving fasteners through the plates into a roof deck.

A further object of the invention is to provide a new and improved installation machine for properly driving fasteners for securing membrane or insulation to a roof deck in an efficient and labor cost effective manner.

A further object of the invention is to provide a new and improved installation machine for installing the fastener perpendicular to the deck and for preventing overdriving the fasteners.

Other objects and advantages of the invention will become apparent from the drawings and the specification.

DETAILED DESCRIPTION OF THE INVENTION

Figure 2:
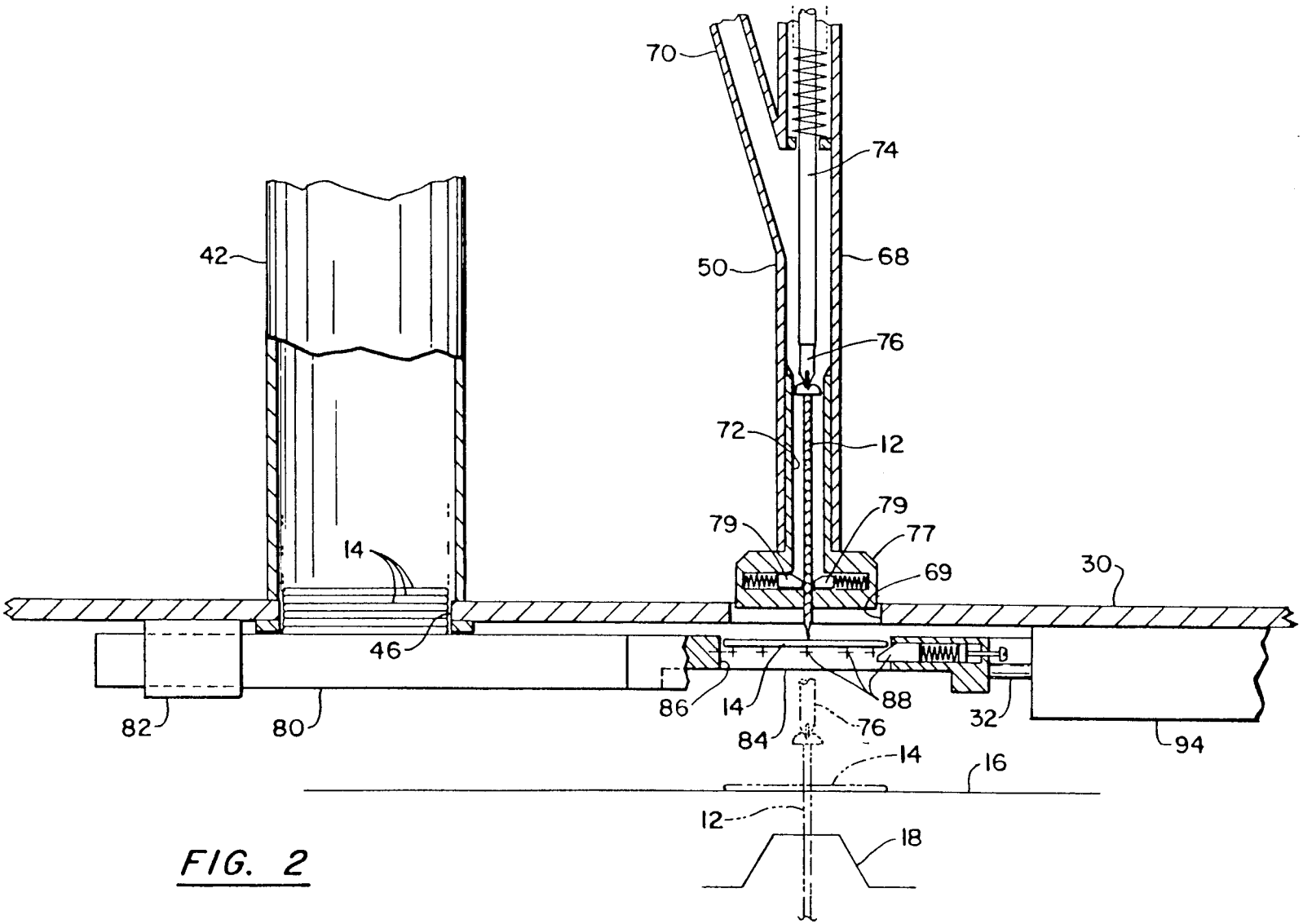
FIG. 2. is an enlarged fragmentary sectional view of the installation machine of FIG. 1 illustrating the operation thereof in phantom.

With reference to the drawings wherein like numerals represent like parts throughout the figures, an installation machine, in accordance with the present invention, is generally designated by the numeral 10. Installation machine 10 is especially adapted for installing fasteners 12 which are driven through washers or plates 14 for securing roofing membrane or insulation material 16 to the deck of a roof 18, as best illustrated in FIG. 2. The installation machine 10 automatically feeds a plate 14 to a pre-installation position wherein a loaded fastener 12 is driven through the fastener plate and roofing material 16 for securement to the roof deck. The installation machine is then wheeled to a succeeding location where the installation process is replicated.

Figure 5:
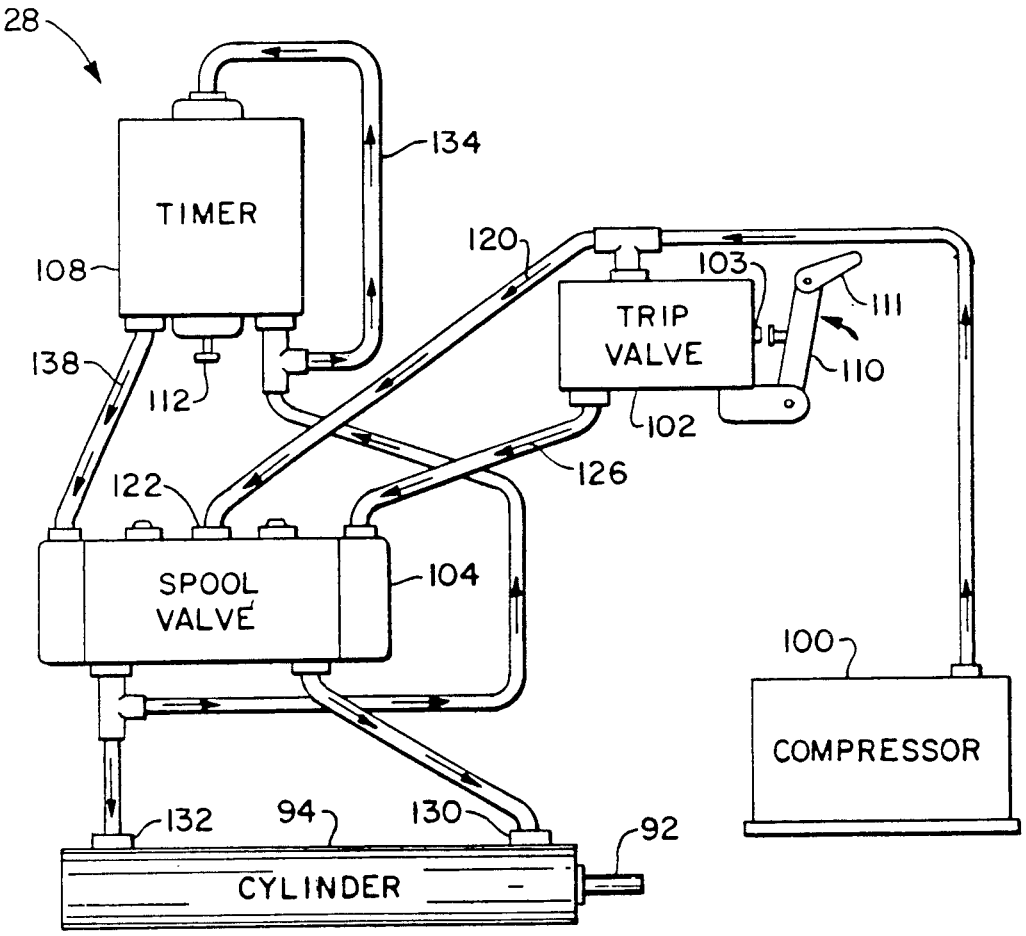
FIG. 5 is a schematic diagram of the pneumatic system employed in the installation machine of FIG. 1.
Figure 4:
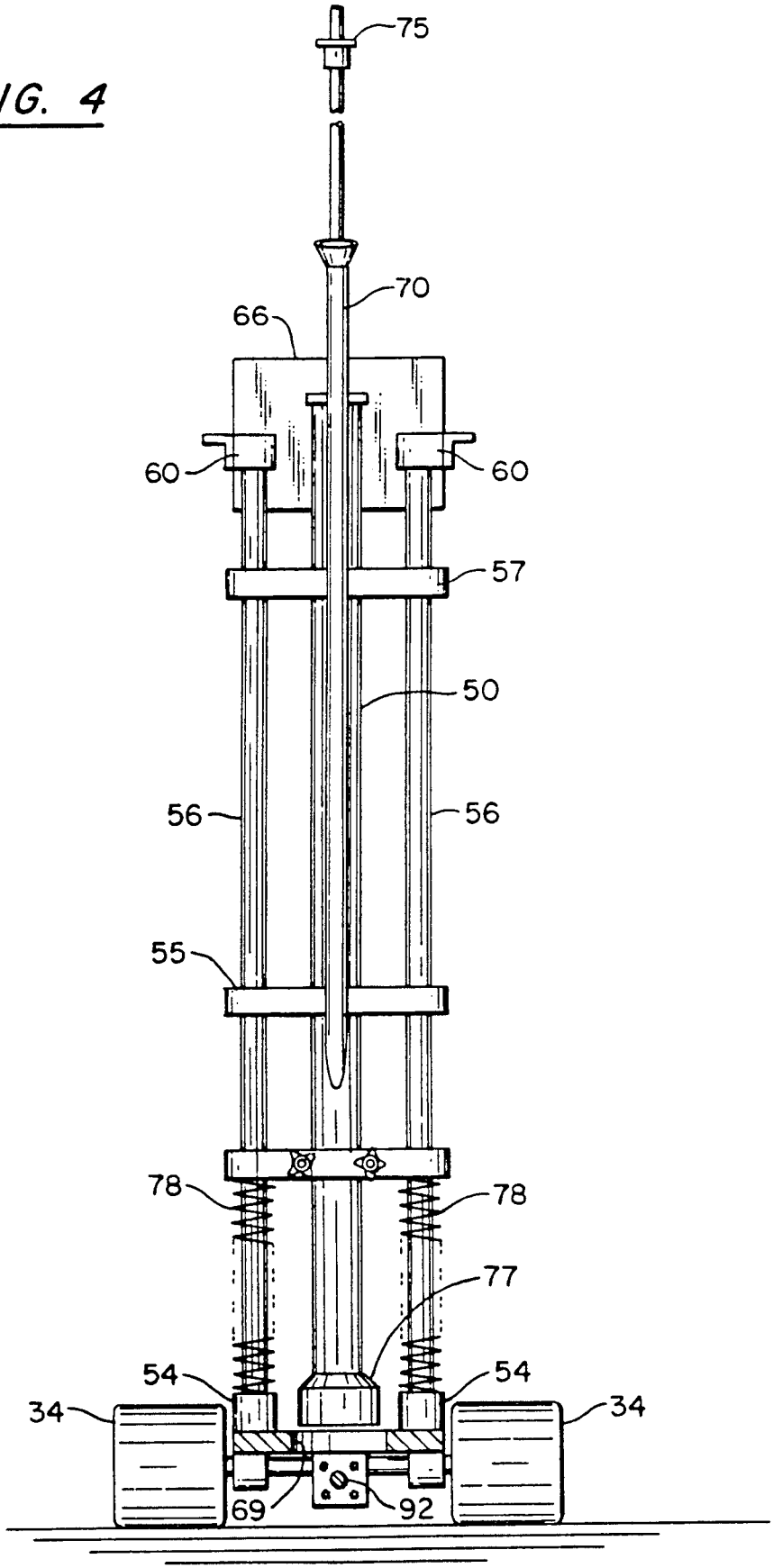
FIG. 4 is an enlarged fragmentary interior sectional view portion of the installation machine taken along the line 4—4 of FIG. 1.

The installation machine 10 generally comprises a carrier 20. The carrier 20 mounts a plate chute 22 and a power driver assembly 24 for driving the fasteners through the plate. A feed mechanism 26 sequentially receives plates from the chute 22 and feeds the plates for alignment with a fastener. The operation of the machine is partially controlled and powered by a pneumatic system 28 illustrated in FIG. 5.

The carrier 20 includes a base frame 30 which mounts a pair of front roller wheels 32 and a pair of rear roller wheels 34 to facilitate moving the machine along the roof. An upright support 36 projects vertically from the base plate and mounts a rearwardly projecting handlebar 38. The handlebar may be gripped by the operator to facilitate movement of the machine. A brake 40 is pivotally mounted for actuation by the foot of the operator to effect engagement with at least one of the rear wheels 34 for temporarily locking the machine at a fixed location during the installation process.

The plate chute 22 comprises a cylindrical tube 42 which is secured to the base frame by angle mounts 44. The chute is located on the central directional axis of the carrier at an intermediate position between the front wheels 32 and rear wheels 34. The chute tube 42 projects generally vertically from the base frame and is opened at the top. The chute is dimensioned to receive a stack of the roofing plates 14. The tube includes one or more longitudinally extending windows 48 so that the supply of plates can be readily visually ascertained. The plates are loaded through the top opening 43 into the tube. The chute communicates through an opening 46 of the carrier base. The plates are released to the feed mechanism 26 through the opening 46. The chute is preferably dimensioned and shaped for a given fastener plate. For example, if the plates are square, the chute could be rectilinear in shape rather than cylindrical.

The power driver assembly 24 comprises a standup tool 50 and a power screw gun 52 for driving the tool 50. Mounting blocks 54 are secured to the base frame 30 for fixably mounting a pair of parallel guide rods 56. Two vertically spaced yokes 55 and 57 are slidably mounted to the guide rods 56. Each yoke comprises cooperative sections which are contoured to receive the standup tool. Knobs 59 are tightened to fixably clamp the standup to the lower yoke 55. The standup tool is thus mounted in a vertical orientation at a location disposed between the supply chute tube 42 and the rear upright support 36.

A horizontal cross-member 58 extends from the upright support 36 and connects via brackets 60 with the upper portion of the guide rods. A fastener bin 66 of rectangular metal form is mounted to the cross member 38. The fasteners may be stored in the fastener bin 66 until usage in the installation machine.

With reference to FIG. 2, the standup tool 50 includes a cylindrical upright casing 68 which mounts an angularly projecting load tube 70. The fasteners 12 are manually loaded into the upper end of the load tube. The fastener slides into a guide sleeve 72. A spring loaded drive shaft 74 in the casing interior mounts a screw bit 76 which is engageable with the head of the fastener for torqueably driving the fastener upon activation of the power gun 52 and downward loading of the casing 68.

A centering nose 77 at the lower terminus of the casing 68 is downwardly displaceable through an opening 69 of the frame to engage the plate and force the plate into engagement against the insulation material 16 to ensure proper positioning of the fastener. A pair of springs 78 releasably upwardly return the nose and casing to the non-driving position. The pre-load of the springs 78 may be adjusted by loosening knobs 59 and adjusting the position of the yoke 55 relative to the casing 68. A pair of spring loaded jaws 79 in the nose adjacent the terminus of the guide sleeve maintains the fastener in a perpendicular relationship to the deck and plate and allows for release of the fastener. The penetration depth is established by a threadably adjustable interference plate 75 at the upper portion of the drive shaft 74.

Figure 1:
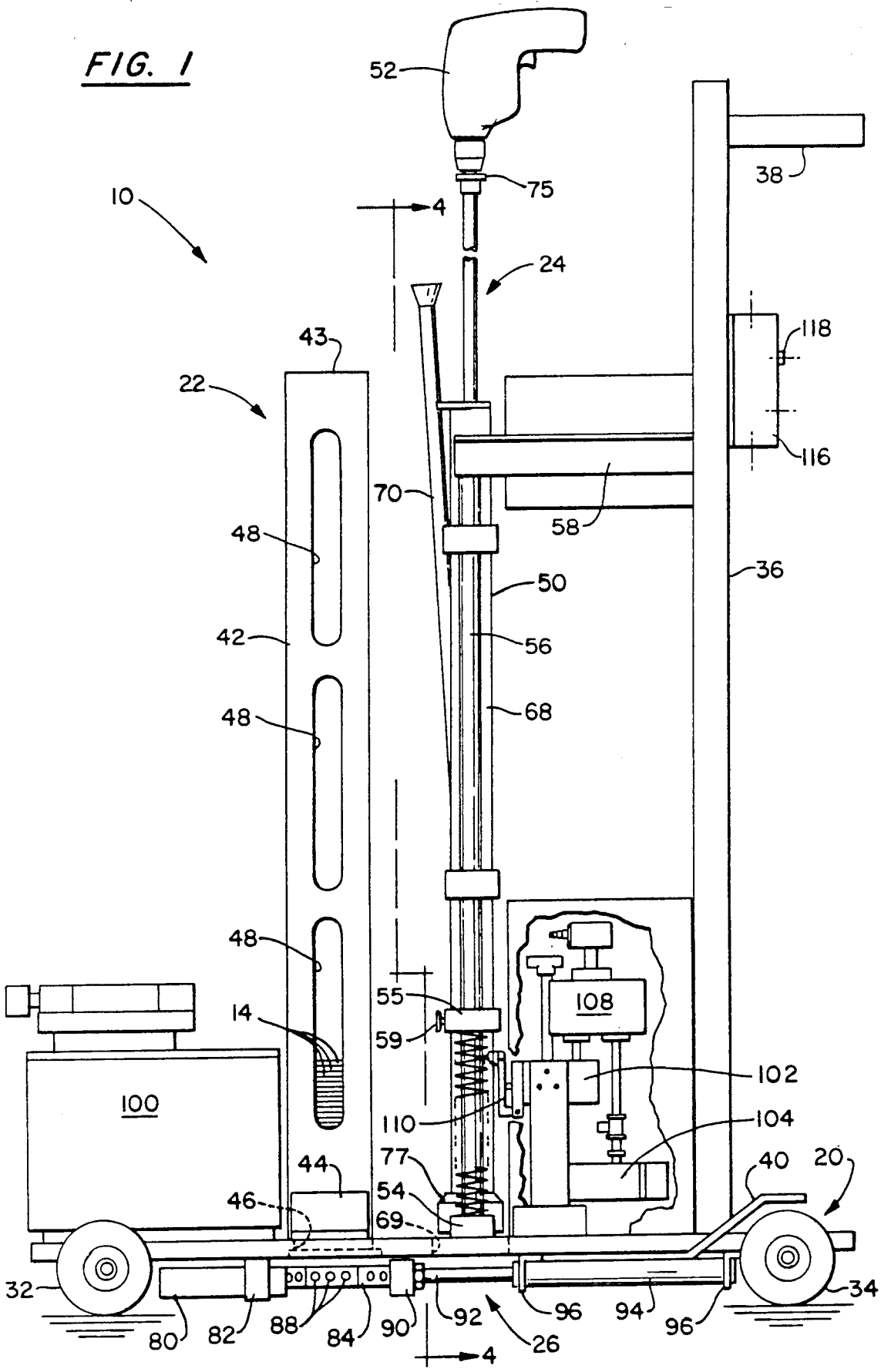
FIG. 1 is a side elevational view, partly broken away with portions removed, of a roof fastener installation machine in accordance with the present invention.

The pneumatically powered feed mechanism 26 includes a slidable transfer arm 80 which is secured by a bracket 82 at the underside of the base frame. The transfer arm 80 connects with a shuttle 84 which is alignable under the opening 46 below the supply chute. The shuttle/chute alignment is illustrated in FIG. 1. The shuttle 84 has an opening 86 which is approximately equal (slightly greater) to the diameter of the plates. A plurality of spring loaded retainer fingers 88 project into the opening for releasably retaining the bottommost plate received by the shuttle. The fingers 88 are spring loaded so that a received plate may be relatively easily released from the shuttle upon energizing the standup tool to drive a fastener through the plate. A connector block 90 connects the transfer arm 80 with the drive shaft 92 of a pneumatic cylinder 94. Mounting brackets 96 extend at the underside of the base frame for mounting the pneumatic cylinder in position.

Figure 3:
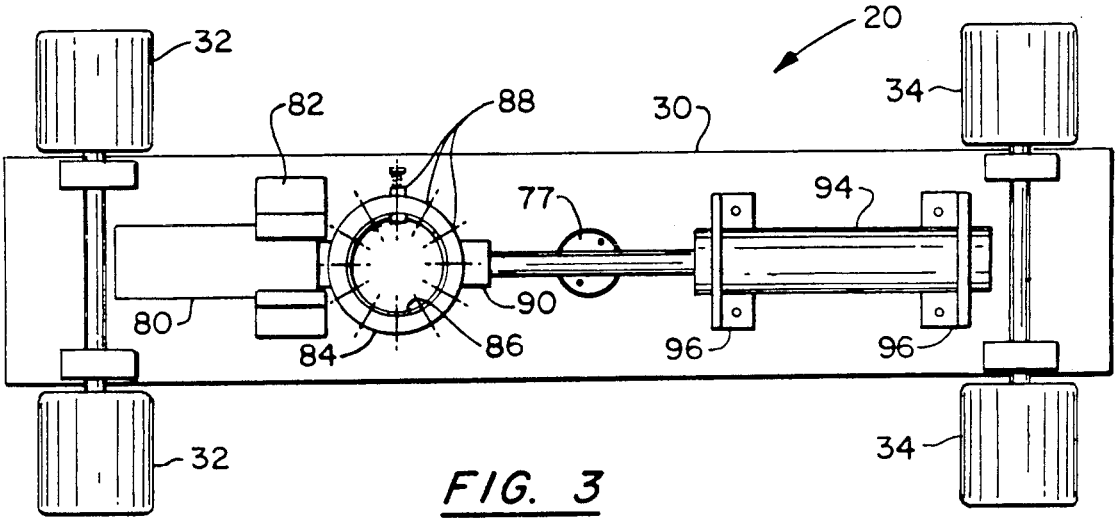
FIG. 3 is a bottom view of the installation machine of FIG. 1.

The operation, including the timing of the pneumatic cylinder 94, is governed by the pneumatic system 28. An air compressor 100 which is mounted at the front of the base frame supplies compressed air for actuating the pneumatic cylinder 94 to displace the shuttle 84 between the pickup position illustrated in FIG. 1 and the installation position illustrated in FIGS. 2 and 3. The compressed air from the compressor is supplied through a pilot line 120 to a pilot port 122 of a pneumatic spool valve 104. The spool valve 104 is displaceable to start an air regulator 108 and also power the shuttle cylinder 94 to drive the shuttle 84 to the pickup position below the chute. The spool valve 104 in an installation mode imposes a pre-established substantially constant pressure to maintain the shuttle at the aligned position below the power driver 24.

The trip valve 102 comprises a microswitch 103 which is tripped by a set screw fixed to a one-way lever arm 110. The lever arm 110 is pivotally actuated (in the direction of the FIG. 5 arrow) by the return of the standup tool to the vertical non-drive position. The lower yoke 55 fixed to the standup tool casing strikes the spring loaded actuating arm 110 on the upward release of the tool 50 after completion of the driving of the fastener and plate. The lever arm 110 has a pivotal end segment 111 which slides past the yoke on the downward driving of the tool 50 but which is engaged by the yoke upon upward release of the tool. Consequently, after the fastener has been driven to the controlled depth through the plate and into the roof deck, the springs 78 bias the tool to the non-drive position to trip the valve 102 and start a new plate loading and feeding sequence. Compressed air traverses a pilot line 120 to a pilot port 122 of the spool valve 104 as well as line 126 which drives the spool valve to terminate the supply of compressed air to cylinder port 130 and to supply air to opposing port 132. The spool valve equilibrium results in the supply of compressed air to the drive end of the cylinder and also the supply of compressed air via line 134 to a timer or regulator 108. The air cylinder then drives the shuttle to the supply chute to pick up a new plate.

The shuttle reciprocates to feed the new plate to the aligned installation position below the standup tool. The timing is regulated by a pneumatic regulator 108 which may be Norgren three-way time delay valve. The regulator 108 imposes a time delay which is activated by the tripping of the actuating arm 110 to impose a pre-established time delay at the plate load position. The delay interval is adjustably set by a screw 112 in the regulator 108. The delay is typically on the order of two seconds. The timing is suitably adjusted so that a new plate is picked up by the shuttle and fed to the correct position just prior to the driving of the fastener into the plate and into the roof deck. Upon release of the regulator valve, the compressed air is supplied via line 138 which drives the spool valve to re-supply air to the retraction port 130 of the cylinder to thereby move the shuttle 84 below the power driver unit 24. It should be appreciated that the fasteners are hand fed into the loading tube. The initial plate may be fed by priming the power driver tool 50 without a fastener.

In operation, a stack of plates 14 is initially loaded into the chute 42 and a supply of fasteners 12 is initially placed in the bin 66. The machine is moved to the desired location for installing a plate/fastener. The brake is then manually set. A plate is automatically fed from the tube to an aligned location below the standup tool. A fastener 12 is dropped into the loading tube with the fastener head in the upper vertical position. The power gun 52 is then actuated and the tool 50 forced downwardly for driving the fastener through the plate. The plate/fastener assembly releases from the retaining fingers when the drive force exceeds a certain low pre-established threshold. The drive torque is continuously applied to the fastener until a pre-established fastener penetration depth is attained.

It should be appreciated that the foregoing sequence is replicated as the installation machine is sequentially positioned along the roof seam and the tool 50 actuated. The plates are automatically fed in position in response to the release of the standup tool, which upon upward displacement, trips the lever arm 110 to actuate the pneumatic shuttle and the timing control regulator. The brake 40 may be set at each installation location for securing the machine at the given position along the roof.

An electrical box 116, for providing electrical connection for the power gun 52 and the compressor 100 is mounted at a forward upper portion of the upright support 36. An on/off switch 118 is provided for the air compressor.

While a preferred embodiment of the invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A machine for installing roofing plate/fasteners on a roof deck comprising:

carrier means comprising a frame and front and rear wheels for moving said frame across a roof;

power driver means mounted to said frame for receiving a fastener and torqueably driving said fastener into said roof;

plate feed means for feeding a plate for alignment with a fastener received in said power driver means, said plate feed means comprising:

chute means mounted to said frame for receiving a stack of plates;

shuttle means for receiving a bottom plate from said chute means stack and transferring said plate to a position aligned with a received fastener, said shuttle means comprising a shuttle member defining an opening having a diameter approximately equal to the diameter of a plate received in said chute means and a plurality of angularly spaced spring loaded fingers mounted to said shuttle means and projectable into said opening for releasably supporting a plate in said shuttle member;

control means responsive to the actuation of said driver means for reciprocating said shuttle means in coordinated relationship with said driver means, so that a plate may be automatically positioned in alignment with a fastener and said driver means is activatable to drive said fastener through said positioned plate and into the roof.

2. The installation machine of claim 1 wherein said control means further comprises compressor means for providing a source of compressed air and comprising pneumatic drive means in communication with said source of air for reciprocating said shuttle means.

3. The installation machine of claim 1 wherein said power driver means comprises a casing which is releasably upwardly displaceable relative to said frame after driving a fastener and said control means further comprises a pivotal member engageable with said drive means and pivotally positionable in response to the upward displacement of said driver means, and a pneumatic valve, said valve being responsive to a selected position of said pivotal member for reciprocating said shuttle means between a position below said chute means to a position aligned with a received fastener.

4. The installation machine of claim 3 further comprising a fixed member mounted in fixed relationship to said casing, said pivotal member engaging said fixed member and being pivotally activatable in response to upward displacement of said casing and being non-activatable on downward displacement of the casing.

5. The installation machine of claim 1 wherein said shuttle means is disposed at the underside of said frame and further comprising a pneumatic cylinder having a reciprocable drive shaft in drive communication with said shuttle member for reciprocating said shuttle member.

6. The installation machine of claim 5 wherein said pneumatic valve selectively controls communication of compressed air to said pneumatic cylinder and is releasable to permit compressed air communication with said pneumatic cylinder to drive said shuttle means toward said chute means and further comprising pneumatic timing means for implementing a pre-established time delay interval to the release of said pneumatic valve to regulate the timing of the plate feed means.

7. The installation machine of claim 1 further comprising upright means mounted to said frame at the rear portion thereof, said upright means mounting a handlebar for facilitating movement of said carrier means.

8. A machine for installing roofing plate/fasteners on a roof deck comprising:

carrier means comprising a frame and wheel means for moving said machine across a roof;

power driver means mounted to said frame for receiving a fastener and torqueably driving said fastener into said roof, said driver means comprising a casing which is upwardly displaceable relative to said frame after driving a fastener;

plate feed means for feeding a plate for alignment with a fastener received in said power driver means, said plate feed means comprising:

chute means mounted to said frame for receiving a stack of plates;

shuttle means for receiving a bottom plate from said chute means stacked and transferring said plate to a position below said power driver means;

control means responsive to the actuation of said driver means for reciprocating said shuttle means between said chute means and said driver means in coordinated relationship with said drier means, said control means comprising a member engageable with said drive means and positionable in response to the upward displacement of said driver means, and a pneumatic valve responsive to the position of said member for reciprocating said shuttle means between a position below said chute means to a position aligned with a received fastener.

9. The installation machine of claim 8 wherein said control means further comprises compressor means for providing a source of compressed air and comprising pneumatic drive means in communication with said source of air for reciprocating said shuttle means.

10. The installation machine of claim 9 wherein said shuttle means further comprises a shuttle defining an opening having a diameter approximately equal to the diameter of a plate received in said chute means and a plurality of angularly spaced spring loaded fingers mounted to said shuttle and projectable into said opening for releasably supporting a plate in said shuttle.

11. The installation machine of claim 10 wherein said shuttle means is disposed at the underside of said frame and further comprising a pneumatic cylinder having a reciprocatable drive shaft in drive communication with said shuttle for reciprocating said shuttle.

12. The installation machine of claim 11 wherein said pneumatic valve selectively controls communication of compressed air to said pneumatic cylinder and is displaceable to permit compressed air communication with said pneumatic cylinder to drive said shuttle means toward said chute means and further comprising pneumatic timing means for implementing a pre-established time interval to said pneumatic valve to regulate the timing of the plate feed means.

13. A machine for installing roofing plate/fasteners on a roof deck comprising:

carrier means comprising a frame having top and bottom portions;

power driver means mounted to said frame and projecting generally from the top portion for receiving a fastener and torqueably driving said fastener downward into said roof;

plate feed means for feeding a plate for alignment with a fastener received by said driver means, said plate feed means comprising:

chute means spaced from said driver means and mounted to said frame for receiving a stack of plates;

shuttle means disposed generally below said frame bottom for receiving a plate from said chute means stack and transferring said plate to a position below said power driver means, said shuttle means comprising a shuttle defining an opening and a plurality of angularly spaced biased fingers mounted to said shuttle and projectable into said opening for releasably support a plate in said shuttle;

control means responsive to the operation of said driver means comprising pneumatic pressure means for reciprocating said shuttle means in coordinated relationship with said driver means, so that a plate may be automatically positioned below said driver means and said driver means is activatable to drive said fastener through said positioned plate wherein said plate releases from said shuttle means.

14. The installation machine of claim 13 wherein said control means further comprises compressor means for providing a source of compressed air and comprising pneumatic drive means in communication with said source of air for reciprocating said shuttle means.

15. The installation machine of claim 13 wherein said power driver means comprises a casing which is releasably upwardly displaceable relative to said frame after driving a fastener, and said control means further comprises a pivotal member engageable with said drive means and pivotally positionable in response to the upward displacement of said driver means, and a pneumatic spool valve, said valve being responsive to the pivotal member for reciprocating said shuttle means between a position below said chute means to a position aligned with a received fastener.

16. The installation machine of claim 13 wherein said shuttle means is disposed at the underside of said frame and further comprising a pneumatic cylinder having a reciprocatable drive shaft in drive communication with said shuttle for reciprocating said shuttle.

17. The installation machine of claim 16 wherein said pneumatic valve selectively controls communication of compressed air to said pneumatic cylinder and is releasable to permit compressed air communication with said pneumatic cylinder to drive said shuttle means toward said chute means and further comprising pneumatic timing means for implementing a pre-established time delay interval to the release of said pneumatic valve to regulate the timing of the plate feed means.

* * * * *